US008079370B2

(12) United States Patent
Natora

(10) Patent No.: US 8,079,370 B2
(45) Date of Patent: Dec. 20, 2011

(54) SYSTEM FOR REMOVAL OF IMPURITIES FROM SHREDDED TOBACCO RECOVERED FROM DEFECTIVE CIGARETTES

(75) Inventor: Krzysztof A. Natora, Radom (PL)

(73) Assignee: International Tobacco Machinery SP. Z.O.O., Radom (PL)

( * ) Notice: Subject to any disclaimer, the term of this patent is extended or adjusted under 35 U.S.C. 154(b) by 378 days.

(21) Appl. No.: 12/361,885

(22) Filed: Jan. 29, 2009

(65) Prior Publication Data

US 2009/0194117 A1 Aug. 6, 2009

(30) Foreign Application Priority Data

Jan. 31, 2008 (PL) ..... 384360

(51) Int. Cl.
*A24C 1/04* (2006.01)

(52) U.S. Cl. ..... 131/96; 131/196; 131/108; 241/14

(58) Field of Classification Search ..... None
See application file for complete search history.

(56) References Cited

U.S. PATENT DOCUMENTS

| | | | | |
|---|---|---|---|---|
| 2,881,772 | A * | 4/1959 | Touey et al. | 131/332 |
| 4,278,100 | A * | 7/1981 | Thatcher | 131/196 |
| 4,867,179 | A | 9/1989 | Leonard | |
| 5,191,904 | A | 3/1993 | Arents et al. | |
| 6,371,126 | B1 * | 4/2002 | Korte et al. | 131/110 |

FOREIGN PATENT DOCUMENTS

| | | | |
|---|---|---|---|
| DE | 2307075 | A1 | 8/1974 |
| DE | 3125180 | | 1/1983 |
| DE | 4319957 | | 11/1994 |
| EP | 0990395 | A1 | 4/2000 |
| GB | 2039814 | | 11/1978 |
| PL | 303858 | | 6/1994 |
| PL | 195759 | | 10/2000 |

OTHER PUBLICATIONS

Report on prior art of P 384360 dated Jul. 2, 2008.
European Search Report for EP 09 15 1493 dated May 5, 2009.

* cited by examiner

*Primary Examiner* — Richard Crispino
*Assistant Examiner* — Phu Nguyen
(74) *Attorney, Agent, or Firm* — Marshall, Gerstein & Borun LLP

(57) ABSTRACT

A system is used for removal of impurities from shredded tobacco recovered from defective cigarettes, especially activated carbon particles, as used in a machine for recovering tobacco and having separating sieves and suction devices, where in a transport zone for a mixture of shredded tobacco, paper and impurities, positioned directly downstream the device for final tearing of the cigarette paper, with the zone defining a turbulent flow zone for the mixture of shredded tobacco, paper and impurities, a separating device is installed which defines a first purification zone. The device has a grid, a vacuum system for maintaining turbulent flow of the mixture of shredded tobacco, paper and lightweight impurities, positioned above the grid having a mesh size larger than the size of heavy impurities, and a vacuum system for receiving heavy impurities. Then a second purification zone includes a vibrating sieve with a mesh size larger than the size of heavy and lightweight impurities. A vacuum dust removing device, defining a third purification zone, has a transport pipe with flow disturbing elements, a rotational sieve having a grid of a mesh size suitable for suction of volatile impurities, a flow guide means adjacent the sieve and defining at the same time a flow disturbing element, and a rotary chamber valve positioned under the sieve.

1 Claim, 1 Drawing Sheet

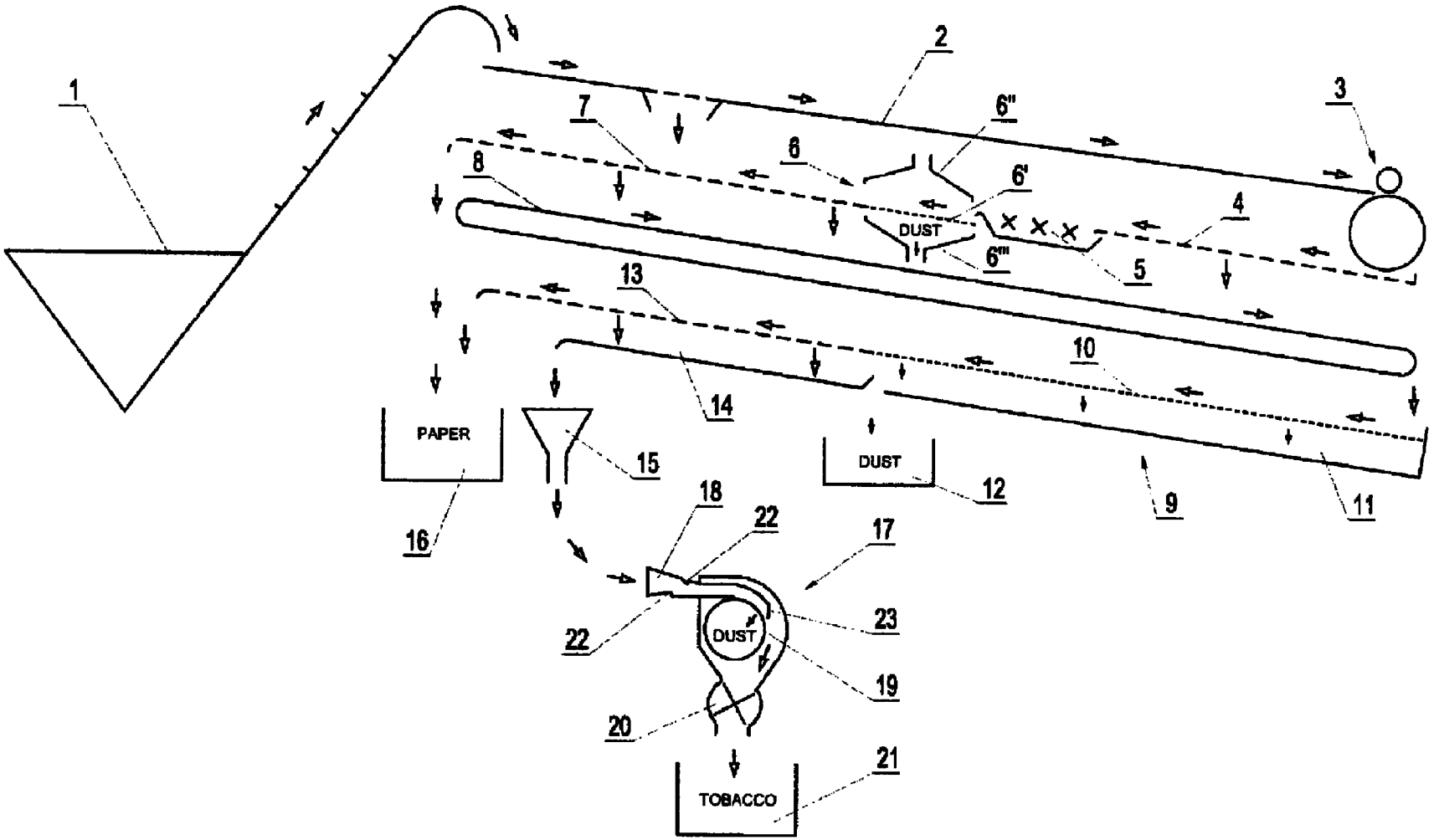
DUST
DUST
DUST
PAPER
TOBACCO

SYSTEM FOR REMOVAL OF IMPURITIES FROM SHREDDED TOBACCO RECOVERED FROM DEFECTIVE CIGARETTES

CROSS-REFERENCE TO RELATED APPLICATION

The present application claims the benefit of priority of Polish Patent Application No. P 384360, filed Jan. 31, 2008. The entire text of the priority application is incorporated herein by reference in its entirety.

FIELD OF THE DISCLOSURE

The disclosure provides a system for removal of impurities from shredded tobacco recovered from defective cigarettes, especially particles of powdered activated carbon, such as a system installed in a machine for recovering tobacco.

BACKGROUND

The Polish Utility Model Application No. 105284 teaches a separator device used for purifying sowable seed and similar materials from impurities of a size different than the seed size. According to the solution, the separator is provided with a movable web comprising a plurality of apertures and a plate with apertures positioned slant thereto. Under the plate, a suction device is mounted, this device being used for removal of fine impurities adhered to the plate. The separator has also separate ducts for receiving materials of various grain size.

The Polish Patent specification No. 195759 B1 shows a structure of a device for conveying filter rods for tobacco industry, that device being provided with a chamber for capturing particles of charcoal which enter it forced by a centrifugal force generated as a result of a change of direction of flow of filter rods being transported. The carbon particles accumulated in the escapement chamber are discharged from the device by means of a suitable lock.

During recovering tobacco from filtered cigarettes, constituting waste from manufacturing line, according to the known solution, a strong contamination of the tobacco with activated carbon occurs. This is caused by penetration of powdered carbon particles from cigarette filters into the final product, i.e. the recovered shredded tobacco. In the known solution, contamination of the shredded tobacco is as high as 100-200 carbon particles per 10 g of recovered shredded tobacco.

In order to recover shredded tobacco from cigarettes, a special machine is used in which the cigarette paper is perforated, and then it is torn along the perforation during being transported on vibrating conveyors and in an assembly for releasing tobacco. In the machine, the defective cigarettes are fed by a feeder onto a vibrating conveyor and transported towards a perforation assembly. The assembly has disc cutters and a grooved drum, where the suitable shape of the cutter teeth and adjustment of cutting depth ensure that only the cigarette paper is incised, without slitting of the filter. Cigarettes with so incised paper are transported along a vibrating conveyor provided with grids, where pre-sifting of the tobacco takes place. Due to a still considerable amount of tobacco remaining within the slit paper, the cigarettes are directed further on to an opening assembly where final tearing of the slit and perforated cigarette paper is effected. Directly downstream the assembly, tobacco, tobacco dust, paper and particles of diverse size, thrown out with a high speed, form a layer of turbulent flow of shredded tobacco, paper and impurities, said layer is next deposited under gravity on vibrating conveyors. As a result of specially selected mesh size in the screen surfaces of the vibrating conveyors, the paper, tobacco and carbon particles are separated in respective zones of the conveyor.

SUMMARY OF THE DISCLOSURE

The disclosure provides a system for removal of impurities from shredded tobacco obtained from defective cigarettes. This system is installed in a machine for recovering tobacco, and it comprises separating sieves and suction devices.

One aspect of the disclosure is that in the zone of transport of the mixture of shredded tobacco, paper and impurities, positioned directly downstream the device for final tearing of the cigarette paper and constituting the zone of turbulent flow of the mixture of shredded tobacco, paper and impurities, a separating device is installed which defines a first purification zone. The device comprises a grid, a vacuum system for maintaining turbulent flow of the mixture of shredded tobacco, paper and lightweight impurities, positioned above the grid with a mesh size larger than the size of heavy impurities, and a vacuum system for receiving heavy impurities. In a further zone of transport of the shredded tobacco, defining a second purification zone, a vibrating sieve is build in, having a mesh size larger than the size of heavy and lightweight impurities. Downstream the second purification zone, a vacuum dust removing device is mounted, defining a third purification zone, comprising a transport pipe with flow disturbing elements, a rotary sieve with a screen having a mesh size suitable for suction of volatile impurities, a flow guide means positioned at the sieve, constituting at the same time a flow disturbing element, and a rotary chamber valve positioned thereunder.

The solution according to the disclosure causes that from a layer of material positioned directly downstream the opening device, approximately 60% of particles of impurities contained in the layer is separated. As a result of the use of a vibrating sieve in the system, further 39.99% of the particles of impurities is removed. After the processed material is passed through all the devices of the system of the disclosure, a purity of the final product in the range of 2-3 particles of impurities per 10 g of recovered tobacco is obtained. This level of impurities is accepted by the cigarette manufacturers.

It is an advantage of the system of the disclosure that high purity of the recovered tobacco is obtained, the tobacco degradation is neglibly low, and the system has small overall dimensions. With the use of the known devices, in order to obtain effects attained in the present disclosure, it would be necessary to use separation screens of an area of about 30 $m^2$.

BRIEF DESCRIPTION OF THE DRAWINGS

An aspect of the disclosure is presented as an embodiment in the drawing of FIG. 1, where:

The system of the disclosure is presented schematically as used for removal of particles of powdered activated carbon from tobacco, and flow of the processed material is indicated with respective arrows.

DETAILED DESCRIPTION

As it is presented, by way of an example, in the drawing, defective cigarettes from a container 1 are fed onto a linear vibrating conveyor 2 and transported to a perforation unit 3. After effecting the perforation of the cigarette paper, the defective cigarettes are transferred along a vibrating conveyor 4 to a device 5 for final tearing of the paper.

Directly downstream this device, there is a separating device 6 that defines a first purification zone and two vacuum systems. A vacuum system 6", for maintaining turbulent flow of the mixture of shredded tobacco, paper and lightweight impurities, is positioned above a grid 6'. A vacuum system 6'" is used for receiving heavy impurities. The grid 6' has a mesh size, for the impurities in a form of activated carbon, of 0.8×0.8 mm. In this part of the machine for recovery of tobacco from cigarettes, due to a high velocity at which the mixture of components of which cigarettes are made is removed from the device 5 for final tearing of the paper, the mixture is at a phase of turbulent flow and it forms a kind of "a cloud" of tobacco mixed with tobacco dust, paper and filtration granulates of different size derived from cigarette filters.

Downstream the separating device 6 there is installed a vibrating conveyor 7 where through the apertures of the sieve surface of the conveyor, onto a continuous conveyor 8 partly purified shredded tobacco is poured, while the paper residues remaining on the vibrating conveyor 7 fall down to a container 16 as wastes. On the conveyor 8, the shredded tobacco is transferred to a vibrating conveyor 9 the construction of which, in the second purification zone, has a built-in sieve 10 of a mesh size corresponding to the size of the impurities being sifted off for the activated carbon of a mesh size of 0.8×0.8 mm. The activated carbon particles sifted on the vibrating sieve 10 fall down to a trough 11 and into a container 12, while the shredded tobacco transferred further on a vibrating conveyor 13 is sifted into a trough 14 and discharged to a funnel 15. The paper residues which are still present on the surface of the vibrating conveyor 13 fall into a container 16.

Downstream the funnel there is installed a vacuum dust removing device 17 which defines a third zone of dust removing. This device comprises a transport pipe 18, a rotational sieve 19 with a screen having a mesh size suitable for suction of volatile impurities, and a rotary chamber valve 20 positioned beneath. The transport pipe 18 is provided with flow disturbing elements 22. At the sieve 10 there is positioned a flow guide means 23. The tobacco purified in the system of the disclosure is poured to a container 21.

I claim:

1. A system for removal of impurities containing particles of activated carbon from shredded tobacco recovered from defective cigarettes, installed in a machine for recovering tobacco and having separation sieves and suction devices, with a zone of transport of a mixture of shredded tobacco, paper and impurities positioned directly downstream of a device for final tearing of cigarette paper, defining a turbulent flow zone for the mixture of shredded tobacco, paper and impurities, comprising: a separator device providing a first purification zone, the separator device having a grid of a mesh size 0.8×0.8 mm, a vacuum system for maintaining turbulent flow of the mixture of shredded tobacco, paper and light impurities, and having another vacuum system positioned directly below the said grid for receiving heavy impurities in the form of activated carbon, a further transport zone for the shredded tobacco defining a second purification zone, a vibrating sieve formed with a mesh size larger than the size of heavy and lightweight impurities, and, downstream of the second purification zone a vacuum dust removing device, the dust removing device defining a third purification zone having a transport pipe with flow disturbing elements, a rotational sieve having a screen of a mesh size suitable for suction of volatile impurities, a flow guide means adjacent the sieve and defining a flow disturbing element, and a rotary chamber valve positioned under the sieve.

* * * * *